United States Patent [19]

Jacob

[11] Patent Number: 4,627,858

[45] Date of Patent: Dec. 9, 1986

[54] VACUUM CLEANER FILTER

[75] Inventor: Gernot J. M. Jacob, Weissach-Flacht, Fed. Rep. of Germany

[73] Assignee: Progress - Electrogeraete, Fed. Rep. of Germany

[21] Appl. No.: 756,978

[22] PCT Filed: Nov. 12, 1984

[86] PCT No.: PCT/EP84/00358

§ 371 Date: Jul. 11, 1985

§ 102(e) Date: Jul. 11, 1985

[87] PCT Pub. No.: WO85/02100

PCT Pub. Date: May 23, 1985

[30] Foreign Application Priority Data

Nov. 17, 1983 [DE] Fed. Rep. of Germany ..... 3341458

[51] Int. Cl.[4] ..... B01D 46/02; A47L 9/14

[52] U.S. Cl. ..... 55/126; 55/267; 55/372; 55/373; 55/379

[58] Field of Search ..... 55/124, 126, 267, 359, 55/372, 373, 378, 379

[56] References Cited

U.S. PATENT DOCUMENTS

| | | | |
|---|---|---|---|
| 2,677,896 | 5/1954 | Sparks | 55/372 X |
| 2,722,993 | 11/1955 | Gerber et al. | 55/373 X |
| 2,794,513 | 6/1957 | Hultberg et al. | 55/372 X |
| 3,636,681 | 1/1972 | Batson et al. | 55/372 |
| 3,744,216 | 7/1973 | Halloran | 55/126 X |
| 3,871,847 | 3/1975 | Fish | 55/372 |
| 3,873,285 | 3/1975 | Allen | 55/372 X |
| 4,406,678 | 9/1983 | Neugart | 55/372 |
| 4,530,817 | 7/1985 | Holter et al. | 55/267 X |
| 4,545,794 | 10/1985 | Himukai | 55/372 X |

FOREIGN PATENT DOCUMENTS

| | | |
|---|---|---|
| 2160587 | 6/1973 | France . |
| 2179226 | 11/1973 | France . |
| 1094832 | 12/1967 | United Kingdom . |
| 2093729 | 9/1982 | United Kingdom . |

*Primary Examiner*—Robert Spitzer
*Attorney, Agent, or Firm*—Alfred E. Miller

[57] ABSTRACT

In known vacuum cleaners a filter bag is arranged as a dust collector in the suction chamber through which the dust laden air stream is led. Although the major part of the dust particles are collected in the filter bag, the air stream leaving the apparatus contains a considerable portion of fine dust particles which spread in the premise being cleaned. To retain inside the vacuum cleaner also the dust particles contained in the exhaust air this air is cleaned by a filter (18) which is integrated with the filter bag (15). Exchange of a filled filter bag means that automatically also the exhaust air filter will be exchanged. Thus, there will be no decrease of the suction effect due to clogging of the exhaust air filter.

13 Claims, 3 Drawing Figures

FIG.1
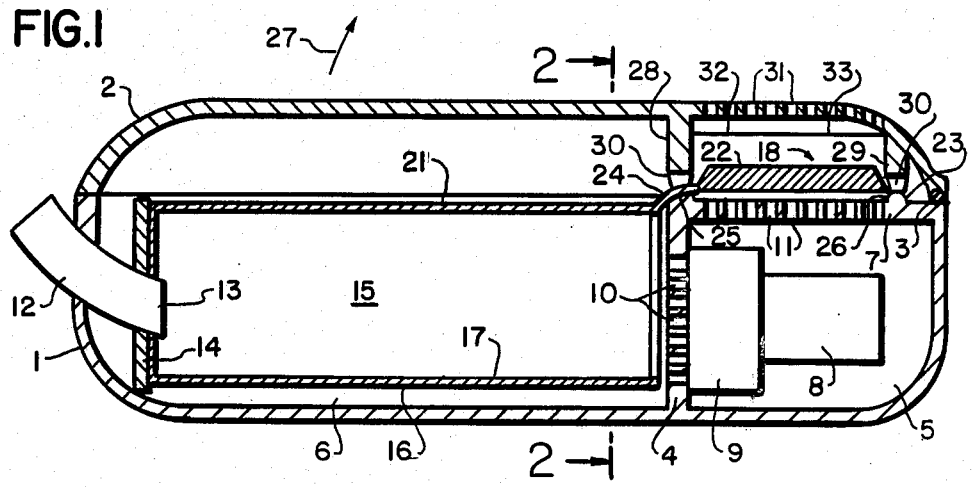
FIG.2
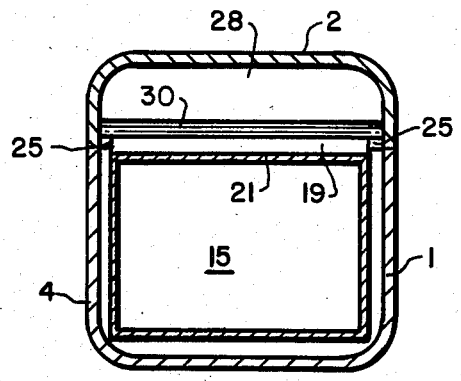
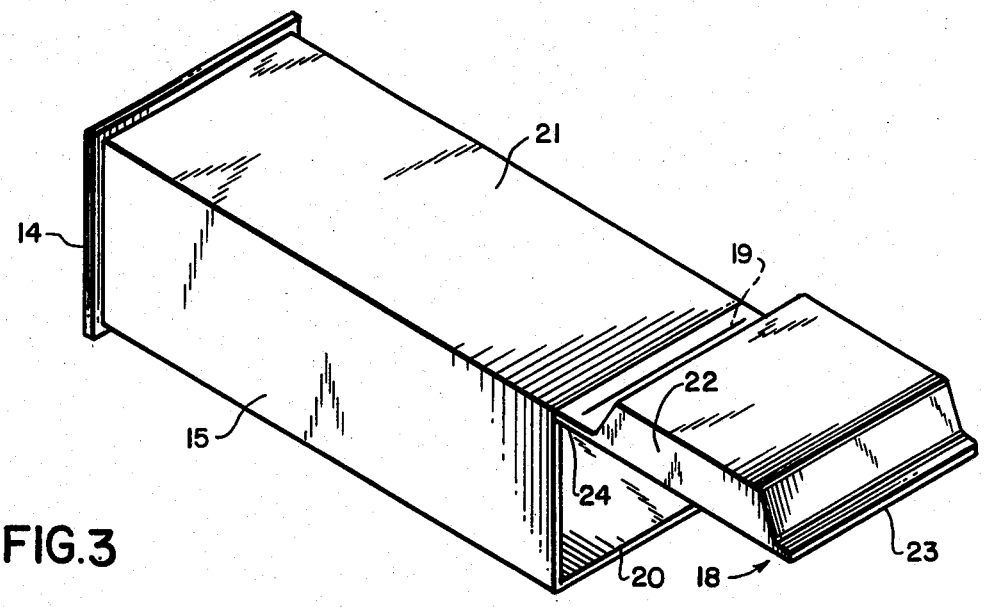
FIG.3

VACUUM CLEANER FILTER

This invention relates to a vacuum cleaner according to the preamble of claim 1.

In known vacuum cleaners the dust collecting filter bag is exchanged when a given quantity of dust has been collected therein so that the flow resistance at the inlet end has become too great which considerably reduces the suction effect of the motor. To provide a maximum filtering of the dust particles carried with the air, these filter bags are preferably made of two layers of filter paper. It is further known in order to protect the motor to provide a stationary coarse-meshed filter grating at the exhaust end of the vacuum cleaner. Even when the grating is fine-meshed the exhaust air will carry a considerable amount of fine dust particles so that although the major part of the dust collected during vacuum cleaning is retained in the filter bag the fine particles of the dust will be blown out together with the exhaust air. Thus, a satisfactory cleaning of premises will not always be obtained. Although the pores of the filter bag after some time of use will be clogged so that the filtering effect is increased this causes the flow resistance at the inlet end to increase to such an extent that the suction effect of the vacuum cleaner will be drastically reduced.

The object of the invention is to clean the exhaust air of a vacuum cleaner also from very fine dust particles and to ensure that the suction effect of the vacuum cleaner is not reduced due to too great a flow resistance at the inlet and/or the outlet end. This object is achieved according to the invention in that the exhaust air is led through a filter which preferably is integrated with the filter bag. By the exhaust air filter arranged in the flow path of the exhaust air the dust particles carried with the exhaust air will be retained so that this air will be substantially free of dust and dirt. After some time of use, however, not only the flow resistance at the inlet end which is caused by the filter bag being filled will be increased but also at the outlet end the flow resistance will increase because of the exhaust air filter successively becoming clogged. The replacement of the filled filter bag which has now become necessary will include in a single operation replacement of the exhaust air filter since the latter is fixed to the filter bag. In this way, full suction effect of the vacuum cleaner is reestablished since the too great flow resistance both at the inlet end and the outlet end has been removed by exchanging the one-piece filter.

The exhaust air filter is preferably formed by at least two layers of filter paper and can either be manufactured as an integrated part of the filter bag or be attached to the filter bag after the manufacture.

Preferably, the portion connecting the filter bag to the exhaust air filter consists, like the exhaust air filter and the filter bag, of a two-ply filter paper so that the exhaust air filter will be steadily fixed to the filter bag and cannot be torn off.

Additional characteristic features of the invention will appear in the following description and in the drawing.

An embodiment of the invention will now be described by way of example with reference to the drawing.

FIG. 1 is a length section through a vacuum cleaner with a filter bag according to the invention, FIG. 2 is a section through the vacuum cleaner on the line II—II of FIG. 1, and FIG. 3 is a perspective view of the filter bag according to the invention.

The vacuum cleaner shown is intended for floor cleaning and comprises a lower housing part 1 with an upper housing part in the form of a cover 2. The cover 2 is swingably and/or removably mounted on a hinge 3 in such a way that the lower housing part 1 is wholly uncovered after opening of the cover 2.

The lower housing part 1 is divided by a vertical wall 4 into a motor space 5 and a dust collecting chamber 6. The motor space is limited by a horizontal wall 7 on the level of the upper edge of the lower housing part 1.

In the embodiment shown a motor 8 with a fan 9 is mounted on the vertical wall 4 limiting the dust collecting chamber 6. The wall 4 is provided with air inlet openings 10 for the fan 9, and outlet openings 11 for the air are provided in the horizontal wall 7.

An air inlet channel 12 extending into the dust collecting chamber 6 is arranged in the lower housing part 1 approximately opposite the vertical wall 4. When the cover 2 is opened the reinforced front wall 14 of a filter bag 15 which is closed at all sides, is pushed over the portion 13 of the inlet channel 12, the latter projecting into the dust collecting chamber in such a way that the opening for the inlet channel in the filter bag will be substantially airtight.

In the embodiment shown (FIG. 3), the filter bag 15 is generally square-shaped and consists of two-ply filter paper, viz. an inner filter layer 17 and an outer filter layer 16 (FIG. 1). The filter bag 15 substantially fills up the entire dust collecting chamber 6 in the lower housing part 1. In order to firmly secure the filter bag, particularly in the portions of the reinforced front wall 14, which for instance can be of cardboard, shoulders, guide grooves, elevations or the like can be provided in the lower housing part.

The end part of the filter bag 15 which is opposite the front wall 14 continues into a generally square filter 18. When the filter bag is inserted in the lower housing part 1 the said filter serves as an exhaust air filter 18 lying over the outlet openings 11 of the horizontal wall 7. In the embodiment shown the exhaust air filter 18 is arranged at the upper edge 19 of the filter bag bottom 20 so that it can be said to be an extension in the length direction of one side surface 21 of the filter bag which surface faces the cover 2 of the vacuum cleaner. The arrangement of the exhaust air filter 18 as an integrated part of the filter bag 15 is dependent on the design of the vacuum cleaner and of the positioning of its outlet openings. Essential for the invention is that the exhaust air filter 18—independent of the design of the vacuum cleaner and of the filter bag—is connected with the filter bag 15. For instance the portion 24 of the exhaust air filter 18 can be glued to or manufactured in one piece with the filter bag. Since the filter bag 15 is fixedly connected to the exhaust air filter 18, each exchange of filter bag will automatically bring about exchange of the exhaust air filter in one operation.

The filter bag shown in FIG. 3 with the connected exhaust air filter 18 consists of two-ply filter paper. Between the filter paper layers of the exhaust air filter, which preferably also is two-ply, a separate filter insert 22 is provided which ensures that also very fine dust particles, particularly particles from the carbon brushes of the electric motor, are retained. As special filter inserts carbon material, odour absorbing material, filter wadding, germ killing material and the like can be used. The filter insert can in such case be inserted between the two layers of the exhaust air filter 18 after or on manufacture of the filter 18.

The filter paper layers of the exhaust air filter 18—at least in the length direction of the filter bag 15—are placed one upon the other at the free end 23 and in the portion 24 between the edge 19 and the filter insert 22. The portion 24 is flexible because of the filter paper so that the exhaust air filter will remain movable about the upper edge 19 of the bottom 20. In the vacuum cleaner housing the free end 23 and the portion 24 of the exhaust air filter 18 lie on bead-shaped elevations 25, 26 extending over the entire width of the horizontal wall 7. As seen in the length direction of the housing 1 the bead-shaped elevation 25 extends in front of and the bead-shaped elevation 26 behind the outlet openings 11, and the elevations 25 and 26 extend over the entire width of the lower housing part 1 as appears from the sectional view of FIG. 2.

For the elevations 25, 26 there are provided mouldings 28, 29 which extend over the entire width of the cover 2. Preferably, on their surfaces facing the respective elevation 25 and 26 each moulding has a soft-elastic edge bead 30 which when the cover 2 is closed presses the free end 23 and the portion 24 of the exhaust air filter 18 onto the elevation 25 and 26, respectively.

Thus, the mouldings 28 and 29 and their edge beads 30, respectively, keep the exhaust air filter 18 in position over the outlet openings 11. Furthermore, due to the fact that the moulding 28 (FIG. 2) and its relevant edge bead 30, which when the cover 2 is closed bears substantially airtightly on the elevation 25, extend over the entire width of the vacuum cleaner, the inlet end (dust collecting chamber 6) of the fan 9 will be substantially airtightly sealed from the outlet end (outlet openings 11) so that the operational capability of the vacuum cleaner is ensured. To improve the sealing effect it may be advantageous to provide a sealing layer on the portion 24 or to form the portion 24 as a sealing element, so that the edge bead 30 can rest on the moulding 28.

The exhaust air space 32 formed by the horizontal wall 7, the moulding 28 and the cover 2 has exhaust air openings 31 in the cover 2 through which the exhaust air from the fan 9 leaves the vacuum cleaner housing. Instead of openings 31 a grating for the exhaust air can be used in the cover 2.

In operation of the vacuum cleaner the dust laden air is drawn in through the inlet channel 12, the dust is retained in the filter bag 15 and the air is blown out via the fan 9 through the outlet openings 11 and 31 after passing through the exhaust air filter 18. Very fine dust particles possibly contained in the exhaust air will be retained by the exhaust air filter, so that air leaving through the openings 31 will be generally free from dust. Thus, also the air circulated by the vacuum cleaner will be clean so that the vacuum cleaner will also serve as an air cleaner.

In the embodiment shown the exhaust air filter 18 can also be of one-ply filter paper which—if its pores are large—after a few minutes will be clogged by dust particles and then will work as a fine filter. In addition to the design of the exhaust air filter 18 with two-ply filter paper and an interposed special filter insert 22 it may be advantegous to use an electrostatic filter. Thus, a filter insert 22 of electrostatically charged material can be used to retain very fine particles, which ensures that the flow resistance at the outlet side will be small.

In a preferred modification of the invention at least one stationary heating element is provided in the flow path of the exhaust air. Such a heating element can comprise one or more than one resistance heating plates disposed in the flow path of the exhaust air, most advantageous, however, is to have a heating element in the form of a resistance grating 33 transverse to the flow direction, which in the embodiment shown is provided in the exhaust air space 32. By flowing through the resistance grating 33 respectively flowing past the heating elements possible bacteria or virus contained in the exhaust air will be killed. Such a vacuum cleaner is therefore particularly suitable for use in hospitals and sanatoriums.

The heating element, in the present embodiment the resistance grating 33, is preferably disposed in the exhaust air space 32 after the exhaust air filter as seen in the flow direction, so that the already cleaned exhaust air will pass the resistance grating 33. In this way it is ensured that the fine-meshed resistance grating 33 will not be clogged by dust particles. It may however also be advantageous to dispose heating elements for bacteria and virus killing in the motor space 5 immediately in front of the outlet openings 11. The advantage of such an arrangement is that the heating elements lie in the motor space 5 so as to be protected against contact and hence from exterior mechanical influence. The arrangement in the motor space 5 further ensures that the operator is protected from any electrical or thermal influence.

If the filter bag 15 is filled with dust and has to be exchanged, the cover 2 is swung in the direction of the arrow 27 about the hinge 3 so that both the filter bag 15 and the exhaust air filter 18 associated therewith become available. Together with the filter bag also the exhaust air filter 18 is removed and thus, the necessary exchange of the exhaust air filter will take place automatically. After exchange of the filter bag the suction capability of the vacuum cleaner is entirely reestablished since the too great flow resistance both at the inlet end and at the outlet end caused by the clogging of the filters (filter bag and exhaust air filter) has been removed.

I claim:

1. A vacuum cleaner comprising a housing, an air inlet channel connected to said housing at one location and an air outlet for discharging exhaust air in said housing at a spaced location from said inlet channel, a dust collecting chamber in said housing, a filter dust bag in said dust collecting chamber connected to said inlet channel, a motor-fan unit in said housing, an exhaust air filter adjacent to said air outlet, a connecting piece connecting said filter dust bag to said exhaust air filter whereby said filter dust bag is positioned upstream of said motor-fan unit and said exhaust air filter is positioned downstream of said motor-fan unit.

2. A vacuum cleaner according to claim 1 wherein said filter dust bag, connecting piece and exhaust air filter is a one-piece element.

3. A vacuum cleaner according to claim 1 wherein said connecting piece connects a marginal edge of said filter dust bag to an adjacent marginal edge of said exhaust air filter whereby said exhaust air filter is disposed laterally from said filter dust bag.

4. A vacuum cleaner according to claim 1, characterized in that the exhaust air filter includes at least two layers of filter paper.

5. A vacuum cleaner according to claim 4, wherein said layers are spaced and further comprising a filter insert arranged in the space between the layers of the filter.

6. A vacuum cleaner according to claim 5, characterized in that the filter insert is of electrostatically charged material.

7. A vacuum cleaner according to claim 5 characterized in that the filter insert consists of germ killing material.

8. A vacuum cleaner according to claim 1 characterized in that the connecting piece connecting the filter dust bag with the exhaust air filter comprises two layers of filter paper.

9. A vacuum cleaner according to claim 1, characterized in that said connecting piece connecting the filter dust bag with the exhaust air filter is made as a sealing element for sealing off the suction side of the vacuum cleaner from its discharge side.

10. A vacuum cleaner as claimed in claim 1 further comprising at least one stationary heating element arranged in the flow path of the exhaust air.

11. A vacuum cleaner according to claim 10, characterized in that the heating element comprises at least one resistance heating plate arranged in the flow path of the exhaust air.

12. A vacuum cleaner according to claim 10, characterized in that the heating element is a resistance grating arranged across the flow path of the exhaust air.

13. A vacuum cleaner according to claim 1 wherein the filter dust bag is generally square in shape and the exhaust air filter lies approximately parallel to the upper side surface of the filter dust bag so that it can be inserted and exchanged together with the filter bag in one operation.

* * * * *